US007388543B2

(12) United States Patent
Vance

(10) Patent No.: US 7,388,543 B2
(45) Date of Patent: Jun. 17, 2008

(54) MULTI-FREQUENCY BAND ANTENNA DEVICE FOR RADIO COMMUNICATION TERMINAL HAVING WIDE HIGH-BAND BANDWIDTH

(75) Inventor: Scott Vance, Staffanstorp (SE)

(73) Assignee: Sony Ericsson Mobile Communications AB (SE)

( * ) Notice: Subject to any disclaimer, the term of this patent is extended or adjusted under 35 U.S.C. 154(b) by 228 days.

(21) Appl. No.: 11/274,557

(22) Filed: Nov. 15, 2005

(65) Prior Publication Data

US 2007/0109202 A1 May 17, 2007

(51) Int. Cl.
*H01Q 1/24* (2006.01)

(52) U.S. Cl. ..... 343/700 MS

(58) Field of Classification Search ..... 343/700 MS, 343/702, 895

See application file for complete search history.

(56) References Cited

U.S. PATENT DOCUMENTS

| | | | | |
|---|---|---|---|---|
| 7,196,674 | B2 * | 3/2007 | Timofeev et al. | 343/810 |
| 7,230,574 | B2 * | 6/2007 | Johnson | 343/702 |
| 2004/0137950 | A1 | 7/2004 | Bolin et al. | |
| 2005/0093750 | A1 | 5/2005 | Vance | |
| 2005/0110692 | A1 * | 5/2005 | Andersson | 343/702 |
| 2005/0237251 | A1 * | 10/2005 | Boyle et al. | 343/770 |
| 2005/0248489 | A1 * | 11/2005 | Kim et al. | 343/702 |
| 2006/0022889 | A1 * | 2/2006 | Chiang et al. | 343/833 |
| 2006/0152411 | A1 * | 7/2006 | Iguchi et al. | 343/700 MS |

FOREIGN PATENT DOCUMENTS

| | | |
|---|---|---|
| JP | 2005020621 | 1/2005 |
| WO | WO 03/075395 A2 | 9/2003 |
| WO | WO 2005/038981 A1 | 4/2005 |

* cited by examiner

*Primary Examiner*—Huedung Mancuso
(74) *Attorney, Agent, or Firm*—Myers Bigel Sibley & Sajovec, P.A.

(57) ABSTRACT

A multi-band radio antenna device for a radio communication terminal is disclosed. The antenna has an integral feed and ground structure electrically connected to a first radiating antenna element and a second radiating element. The first radiating element comprises a first continuous trace of conductive material and has a continuous trace has a first branch tuned to radiate at first frequencies in a first frequency band, and a second branch, which is tuned to radiate in a second frequency band at second frequencies approximately equal to or less than two times the first frequencies. The second radiating antenna element comprises a second continuous trace of conductive material, wherein the second continuous trace has a third branch, which is tuned to resonate in a third frequency band at third frequencies that are higher than the second frequencies, and which is capacitively coupled to the feed and ground structure and arranged substantially adjacent to the second branch. The first branch comprises a first section, composing approximately ⅓ to ⅔ of the total length of the first branch, wherein the first section is essentially straight and connected to said feed and ground structure at a first end thereof, and a second section in direct connection to a second end of said first section that is tightly meandered.

19 Claims, 8 Drawing Sheets

MULTI-FREQUENCY BAND ANTENNA DEVICE FOR RADIO COMMUNICATION TERMINAL HAVING WIDE HIGH-BAND BANDWIDTH

FIELD OF THE INVENTION

This invention pertains in general to the field of antennas for radio communication terminals and, in particular, to compact multi-frequency band antennas devised to be incorporated or built-in into mobile or portable radio communication terminals and having a wide high-bandwidth to facilitate operation of such terminals.

BACKGROUND OF THE INVENTION

The use of radio communication networks is rapidly becoming a part of the daily life for more and more people around the globe. For instance, the GSM (Global System for Mobile Communications) networks offer a variety of functions. Generally, radio communication systems based on such networks use radio signals transmitted by a base station in the downlink over the traffic and control channels are received by mobile or portable radio communication terminals, each of which have at least one antenna. Historically, portable terminals have employed a number of different types of antennas to receive and transmit signals over the air interface. In addition, mobile terminal manufacturers encounter a constant demand for smaller and smaller terminals. This demand for miniaturization is combined with desire for additional functionality such as having the ability to use the terminal at different frequency bands, e.g. of different cellular systems, so that a user of the mobile terminal may use a single, small radio communication terminal in different parts of the world having cellular networks operating according to different standards at different frequencies.

Further, it is commercially desirable to offer portable terminals which are capable of operating in widely different frequency bands, e.g., bands located in the 800 MHz, 900 MHz, 1800 MHz, 1900 MHz and 2.0 GHz regions. Accordingly, antennas which provide adequate gain and bandwidth in a plurality of these frequency bands are employed in portable terminals.

Several attempts have been made to create such antennas. The general desire today is to have an antenna, which is positioned inside the housing of a mobile communication terminal. The most common built-in antennas currently in use in mobile phones are the so-called planar inverted-F antennas (PIFA). This name has been adopted due to the fact that the antenna looks like the letter F tilted 90 degrees in profile. Such an antenna needs a feeding point as well as a ground connection. If one or several parasitic elements are included nearby, they can be either directly coupled to ground or connected to ground via a matching impedance, capacitive coupling, etc. The height of the PIFA antennas is often a limiting factor for decreasing the size of the mobile communication terminal. The geometry of a conventional PIFA antenna includes a radiating element, a feeding pin for the radiating element, a ground pin for the radiating element, and a ground substrate commonly arranged on a printed circuit board (PCB). Both the feeding pin and the ground pin are necessary for the operation of such an antenna, and are arranged perpendicular to the ground plane, wherein the PIFA radiating element is suspended above the ground plane in such a manner that the ground plane covers the area under the radiating element. This type of antenna, however, generally has a fairly small bandwidth in the order of 7% of the operating frequency. In order to increase the bandwidth for an antenna of this design, the vertical distance between the radiating element and the PCB ground may be increased, i.e. the height at which the radiating element is placed above the PCB is increased. This, however, is an undesirable modification as the height increase makes the antenna unattractive for small communication devices and may reduce directivity.

U.S. Pat. No. 6,456,250 discloses a multi frequency band antenna with a low band portion tuned to a low frequency band, a first high band portion tuned to a first high frequency band at higher frequencies than the low frequency band, and a separate, electrically coupled second high band portion that is tuned to a second high frequency band at a higher frequency than the low frequency band and different from the first high frequency band. The low band portion and the first high band portion have a common first grounding point, a common feeding point, and a first conductor portion, which forms part of the low band portion and of the first high band portion. The first conductor portion is electrically connected to the first grounding point and to the common feeding point. The second high band portion is coupled to the first conductor portion. An embodiment of the antenna disclosed in U.S. Pat. No. 6,456,250 is tuned to the frequencies 900 MHz (GSM band), 1800 MHz (DCS band) and 1900 MHz (PCS band).

However, it is desirable to achieve a high gain antenna supporting a single low-band and a wider range of multiple high-bands. It is also desirable to achieve equivalent performance in a smaller volume, which allows for smaller, more attractive phones.

Hence, an improved a multi-band radio antenna device having a wide high-bandwidth would be advantageous. In particular a multi-band radio antenna device allowing for increased efficiency with regard to e.g. size, cost, bandwidth, design flexibility and/or radiation efficiency of the multi-band radio antenna device would be advantageous.

The antenna structure of such an advantageous antenna device is advantageously suitable for built-in antennas, at the same time having a wide high-frequency band bandwidth, which enables the antenna to be operable at a plurality of frequency bands, and having a high efficiency.

More specifically, an antenna with high-gain at high-band would be advantageous, which is both small and has good performance not only in a low frequency band, such as the 900 MHz GSM band, but also good performance in several higher frequency bands, such as the 1800 MHz GSM or DCS band, the 1900 MHz GSM or PCS band, and the 2.1 GHz UMTS band.

SUMMARY OF THE INVENTION

Embodiments of the present invention provide a multi-band antenna device for use in a radio communication terminal, and a radio communication terminal comprising such an antenna device.

According to a first aspect of the invention, a multi-band radio antenna device for a radio communication terminal is provided, comprising an integral feed and ground structure electrically connected to a first radiating antenna element and a second radiating antenna element. The first radiating antenna element comprises a first continuous trace of conductive material and the first continuous trace has a first branch tuned to radiate at first frequencies in a first frequency band, and a second branch, which is tuned to radiate in a second frequency band at second frequencies approximately equal to or less than two times the first frequencies. The second radiating antenna element comprises a second continuous trace of conductive material, wherein the second continuous trace has a third branch, which is tuned to resonate in a third frequency band at third frequencies that are higher than the second frequencies, and which is capacitively coupled to the feed and ground structure and arranged substantially adjacent to the second branch. The first branch comprises a first section, composing approximately ⅓ to ⅔ of the total length of the first branch, wherein the first section is essentially straight and connected to said feed and ground structure at a first end thereof, and a second section in direct connection to a second end of said first section that is tightly meandered.

According to another aspect of the invention, a radio communication terminal is provided, which comprises the multi-band radio antenna device according to a first aspect of the invention. According to one embodiment, the radio communication terminal is a mobile telephone that comprises such a multi-band radio antenna device for RF communication purposes.

Some embodiments of the present invention provide improved antenna efficiency.

Some embodiments of this invention provide antenna design for use in mobile terminals, such as mobile phones, employing a single low-band (e.g. 850 or 900 MHz) as well as frequency band coverage for DCS (Digital Cross-Connect System), PCS (Personal Communications System) and UMTS (Universal Mobile Telephone System).

BRIEF DESCRIPTION OF THE DRAWINGS

These and other aspects and features of the invention will be apparent and elucidated from the following description of embodiments of the present invention, reference being made to the accompanying drawings, in which.

DESCRIPTION OF EMBODIMENTS

Figure 1:
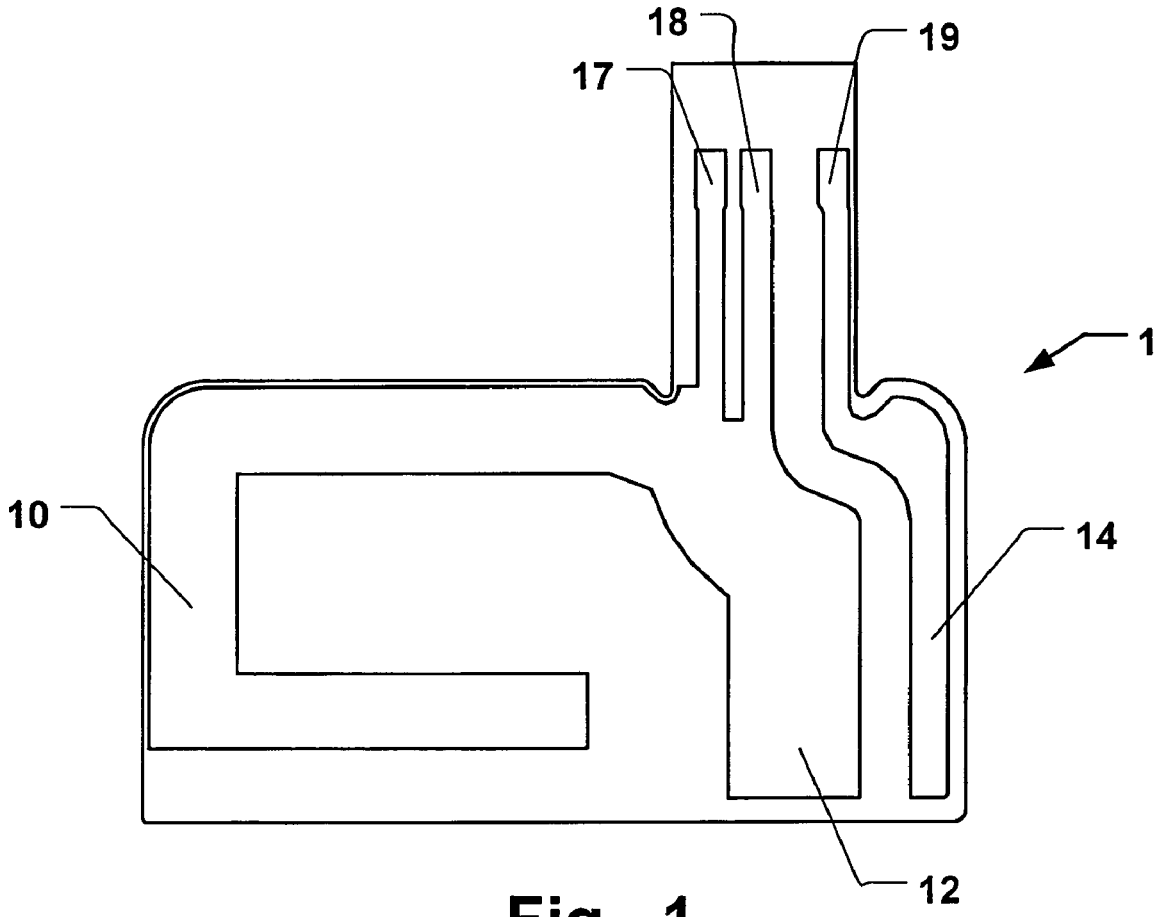
FIG. 1 is a schematic illustration of a multi-band radio antenna device according to an embodiment of the invention.

It will be understood that the Figures, illustrating embodiments of the invention, are merely schematic and are not drawn to scale. For clarity of illustration, certain dimensions may have been exaggerated while other dimensions may have been reduced. Also, where appropriate, the same reference numerals and letters are used throughout the Figures to indicate the same parts and dimensions.

The following description focuses on embodiments of the present invention applicable to a mobile telephone. However, it will be appreciated that the invention is not limited to this application but may be applied to many other mobile communication terminals in which to implement a radio antenna design according to the present invention, including the following examples. The terms mobile or radio communication terminal comprises all mobile equipment devised for radio communication with a radio station, which radio station also may be mobile terminal or e.g. a stationary base station. Consequently, the term mobile communication terminal includes mobile telephones, pagers, communicators, electronic organizers, smartphones, PDA:s (Personal Digital Assistants), vehicle-mounted radio communication devices, or the like, as well as portable laptop computers devised for wireless communication in e.g. a WLAN (Wireless Local Area Network). Furthermore, since the antenna as such is suitable for but not restricted to mobile use, the term mobile communication terminal should also be understood as to include any stationary device arranged for radio communication, such as e.g. desktop computers, printers, fax machines and so on, devised to operate with radio communication with each other or some other radio station. Hence, although the structure and characteristics of the antenna design according to the invention is mainly described herein, by way of example, in the implementation in a mobile phone, this is not to be interpreted as excluding the implementation of the inventive antenna design in other types of mobile communication terminals, such as those listed above.

More precisely, an antenna concept or design is described herein, comprising the structure of the antenna, its performance, and its implementation in a radio communication terminal, with reference to the accompanying drawings.

Figure 2:
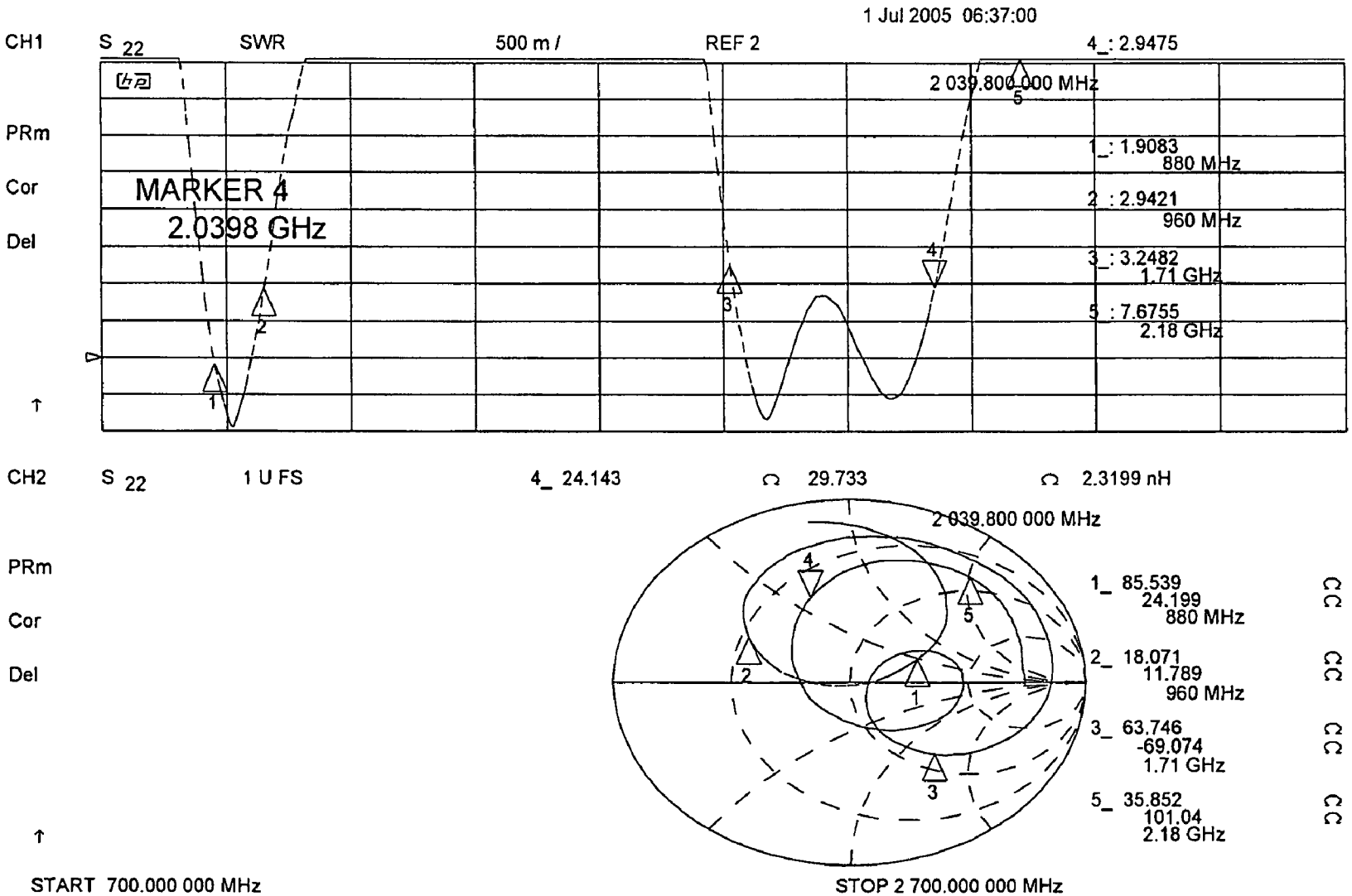
FIG. 2 illustrates the voltage standing wave ratio (VSWR) characteristics for the multi-band radio antenna device of FIG. 1 and a Smith diagram showing the impedance characteristics for the multi-band radio antenna device of FIG. 1.

A schematic illustration of an antenna design is given in FIG. 1. This design achieves good performance in a relatively wide high-band. The design is based on a "parasitic on the side" concept. The antenna 1 comprises a first branch 10 tuned for a low frequency band (e.g. 900 MHz GSM or EGSM), a second, center branch 12 which is tuned for 1900 MHz (e.g. PCS band), and a third branch 14 that is tuned for 1800 MHz (e.g. DCS band). The antenna 1 has three contact points, shown at the top in FIG. 1, which are a Ground contact pin 17, a Feed contact pin 18 and a Ground contact pin 19. FIG. 2 illustrates the voltage standing wave ratio (VSWR—explained below) characteristics of a multi-band radio antenna device of FIG. 1, and a Smith diagram (explained below) showing the impedance characteristics for the multi-band radio antenna device of FIG. 1. This antenna has dimensions of 38 mm (wide)×23 mm (high)×8 mm (high). When attached to a phone about 100 mm in length average gain of this antenna (Freespace) is about −3 dB at low-band and −4~−5 dB in the high-bands.

Figure 3:
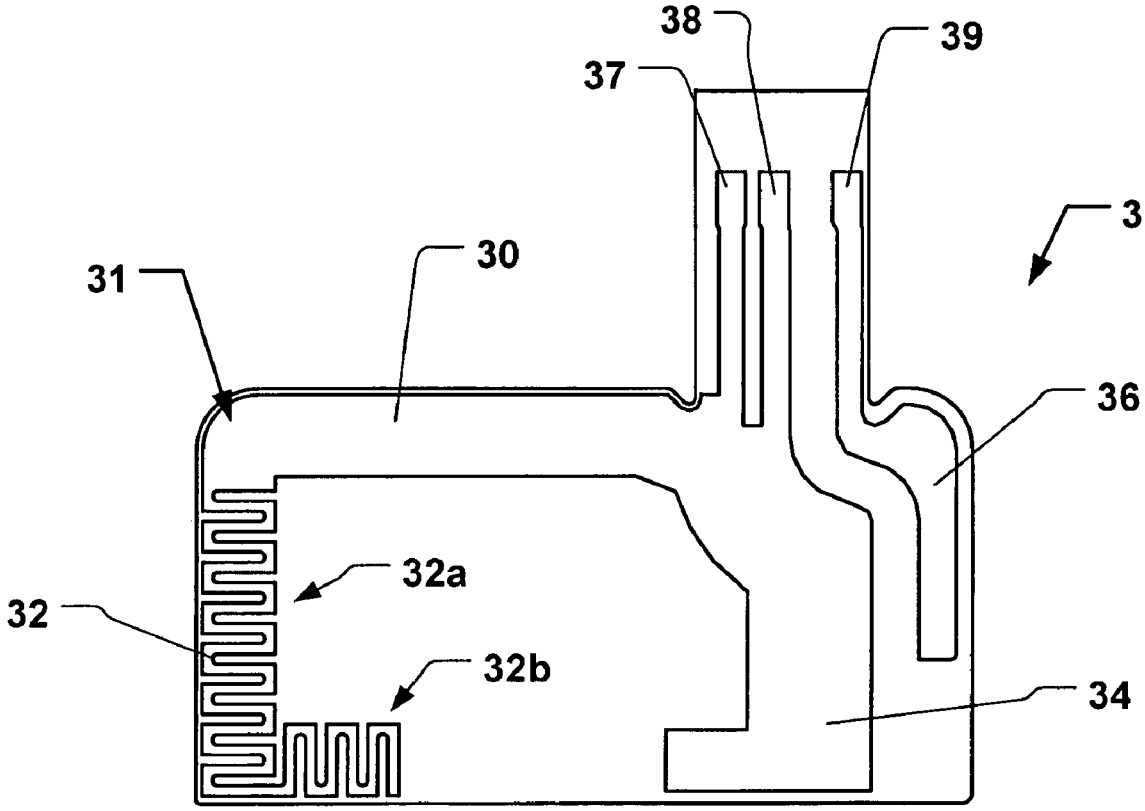
FIG. 3 is a schematic illustration of a multi-band radio antenna device according to an embodiment of the invention.

According to a first embodiment of the invention, illustrated in FIG. 3, an antenna 3 is provided, having improved high-band bandwidth characteristics in comparison to antenna 1. Antenna device 3 has the following elements:

1) A first branch 31 having a first, solid section 30 for a low-band, composing approximately ½ of this branches 31 total length;

2) A second section 32 of the low-band branch 31 which is tightly meandered, wherein the second section 32 of this embodiment comprises two continuously meandered sub-sections 32*a*, 32*b*3) A second branch 34, tuned for the lower part of the high-band; and 4) A third branch 36, tuned for the higher part of the high-band, and capacitively coupled to the feed of the main branches, i.e. 31, 34 and coupled to ground.

The antenna 3 has three contact points, shown at the top in FIG. 3, which are:

1) Left-most: a first ground contact pin 37

2) Center: a feed contact pin 38

3) Right: a second ground contact pin 39

In use the first and second ground contact pins 37, 39 will be electrically connected to ground potential. The feeding pin 38 electrically connects to an electronic circuit for feeding the antenna 3 with signals to be transmitted by the antenna, and/or to electronic circuitry for receiving signals received by the antenna 3.

The two sub-sections 32*a*, 32*b* are suitably arranged so that the meandered portion fits into the area that is available for the antenna. In the present embodiment sub-sections 32*a*, 32*b* are shown arranged substantially perpendicular to each other. However, this geometric arrangement is merely to be taken as an example. Other embodiments may omit the sub-division of the meandered section into several sub-sections oriented differently from each other.

Exemplary, non-limiting dimensions of a specific embodiment of this antenna element 3 are approximately 38×20×(8) mm.

Figure 4:
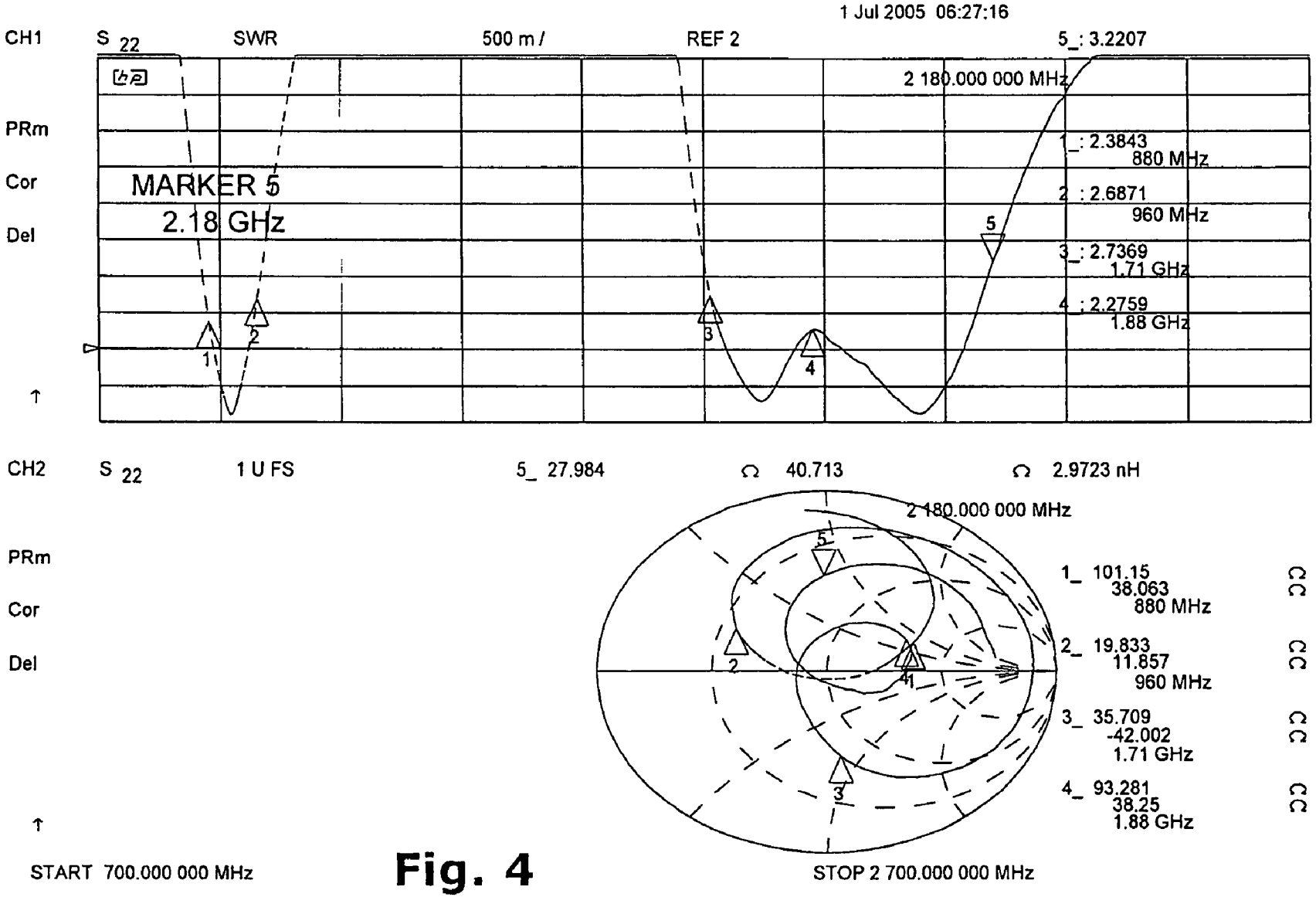
FIG. 4 illustrates the VSWR characteristics for the multi-band radio antenna device of FIG. 3 and a Smith diagram showing the impedance characteristics for the multi-band radio antenna device of FIG. 3.

With this design, the following VSWR shown in FIG. 4 is achieved. The VSWR for low-band is about 2.5:1. At high-band, the VSWR is approximately 3.2:1 at 2180 MHz. However, with further tuning, the entire band may achieve VSWR of better than 3:1.

By tightly meandering the latter section of the low-band branch 31, one may decrease the resonance frequency of the high-band currents on this branch without negatively impacting low-band gain or bandwidth significantly. This allows one to move the DCS branch from the parasitic element 14 to the connected element 34 in the center in order to achieve additional bandwidth at high-band. The size of the element 34 also decreases. More precisely, antenna 3 is a multi-band radio antenna device devised for a radio communication terminal, such as terminal 8 explained below. The antenna has an integral feed and ground structure 37, 38, 39 electrically connected to a first and second radiating antenna element, the first radiating antenna element comprising a first continuous trace of conductive material. The first continuous trace has a first branch 31 tuned to radiate at first frequencies in a first, low frequency band, and a second branch 34, which is tuned to radiate in a second, high frequency band at second frequencies approximately equal to or less than two times the first frequencies. The second radiating antenna element comprises a second continuous trace of conductive material, wherein the second continuous trace has a third branch 36, which is tuned to resonate in a third frequency band at third frequencies that are higher than the second frequencies, and which is capacitively coupled to the feed and ground structure and arranged substantially adjacent to the second branch 34. The first branch 31 comprises a first section 30, composing approximately ½ of the total length of the first branch 31, wherein the first section is essentially straight and connected to said feed and ground structure at a first end thereof. The first section further comprises a second section 32 in direct connection to a second end of the first section that is tightly meandered.

As can be seen in FIG. 3, there is space in the center of the antenna element 3, which is not actively being used. Hence, it may be possible to achieve further miniaturization in other embodiments.

Figure 5:
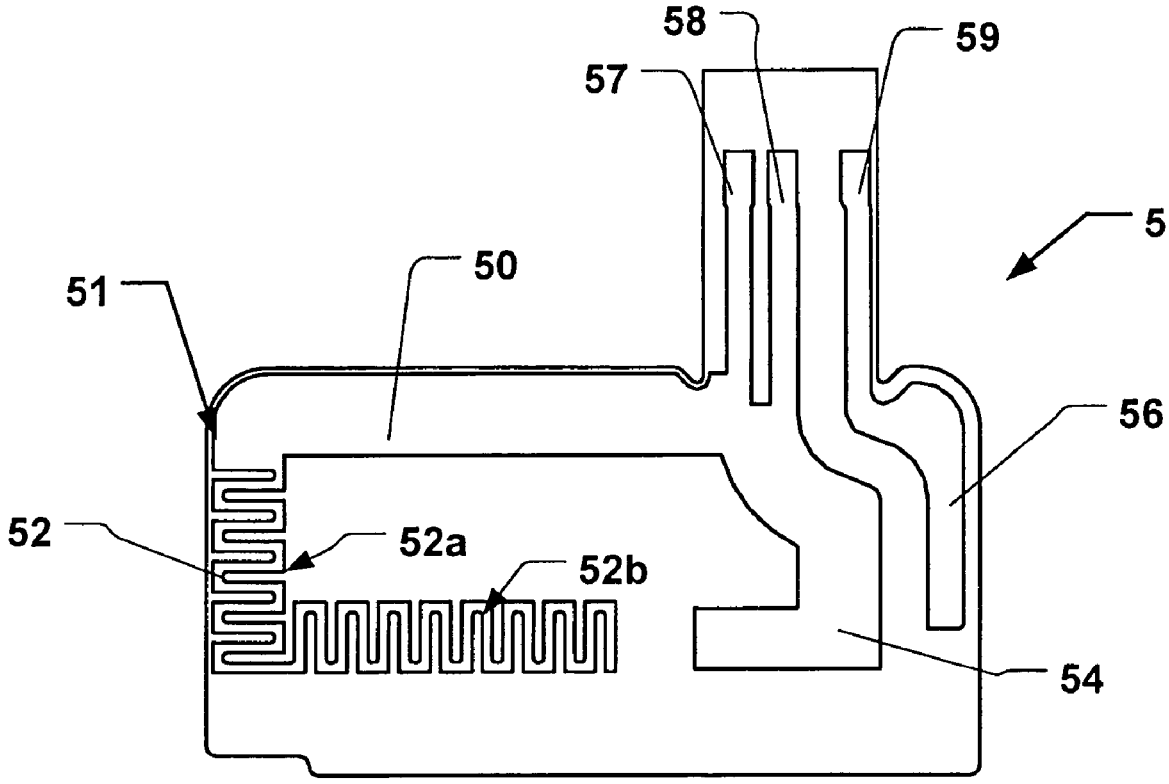
FIG. 5 is a schematic illustration of a multi-band radio antenna device according to another embodiment of the invention.

Another embodiment for a multi-band-antenna device having an antenna element 5 with further decreased size is shown in FIG. 5. Multi-band-antenna 5 comprises the following elements:

1) A first, solid section 50 for the low-band, composing approximately ½ of this branches 51 length;

2) A second section 52 of the low-band branch 51 which is tightly meandered, wherein the second section 52 comprises two sub-sections 52*a*, 52*b* shown substantially perpendicular to each other. Increasing the length of section 52 relative to 51 has the effect of improving the high-band bandwidth, but also results in decreasing the low-band bandwidth of this element. It is therefore important to balance the length of these two branches in order to achieve the best balance of bandwidth and gain over the respective bands. If one were to increase the length of element 52 and decrease the length of element 51 to the point where element 52 were about twice as long as element 51, one would see that the decrease in bandwidth of the low-band resonance would become increasingly unacceptable. However, when element 52 comprises only the last approximately ⅓ of the total length of 51 and 52, the decrease in low-band bandwidth is insignificant compared to the increased bandwidth achieved in the high-band. Hence, the first section of the first branch of embodiments of the invention composes approximately ⅓ to ⅔ of the total length of the first branch. Sub sections 52*a*, 52*b* are suitably arranged on the area available for the antenna.

3) A second branch 54, tuned for the lower part of the high-band; and

4) A third branch 56, capacitively coupled to the feed of the main branches 51, 54 and coupled to ground.

The antenna 5 has three contact points, shown at the top in FIG. 5, which are a Ground contact pin 57, a Feed contact pin 58, and a Ground contact pin 59.

More precisely, antenna 5 is a multi-band radio antenna device devised for a radio communication terminal, such as terminal 8 explained below. The antenna has an integral feed and ground structure 57, 58, 59 electrically connected to a first and second radiating antenna element, the first radiating antenna element comprising a first continuous trace of conductive material. The first continuous trace has a first branch 51 tuned to radiate at first frequencies in a first, low frequency band, and a second branch 54, which is tuned to radiate in a second, high frequency band at second frequencies approximately equal to or less than two times the first frequencies. The second radiating antenna element comprises a second continuous trace of conductive material, wherein the second continuous trace has a third branch 56, which is tuned to resonate in a third frequency band at third frequencies that are higher than the second frequencies, and which is capacitively coupled to the feed and ground structure and arranged substantially adjacent to the second branch 54. The first branch 51 comprises a first section 50, composing approximately ½ of the total length of the first branch 51, wherein the first section is essentially straight and connected to said feed and ground structure at a first end thereof. The first section further comprises a second section 52 in direct connection to a second end of the first section that is tightly meandered.

Figure 6:
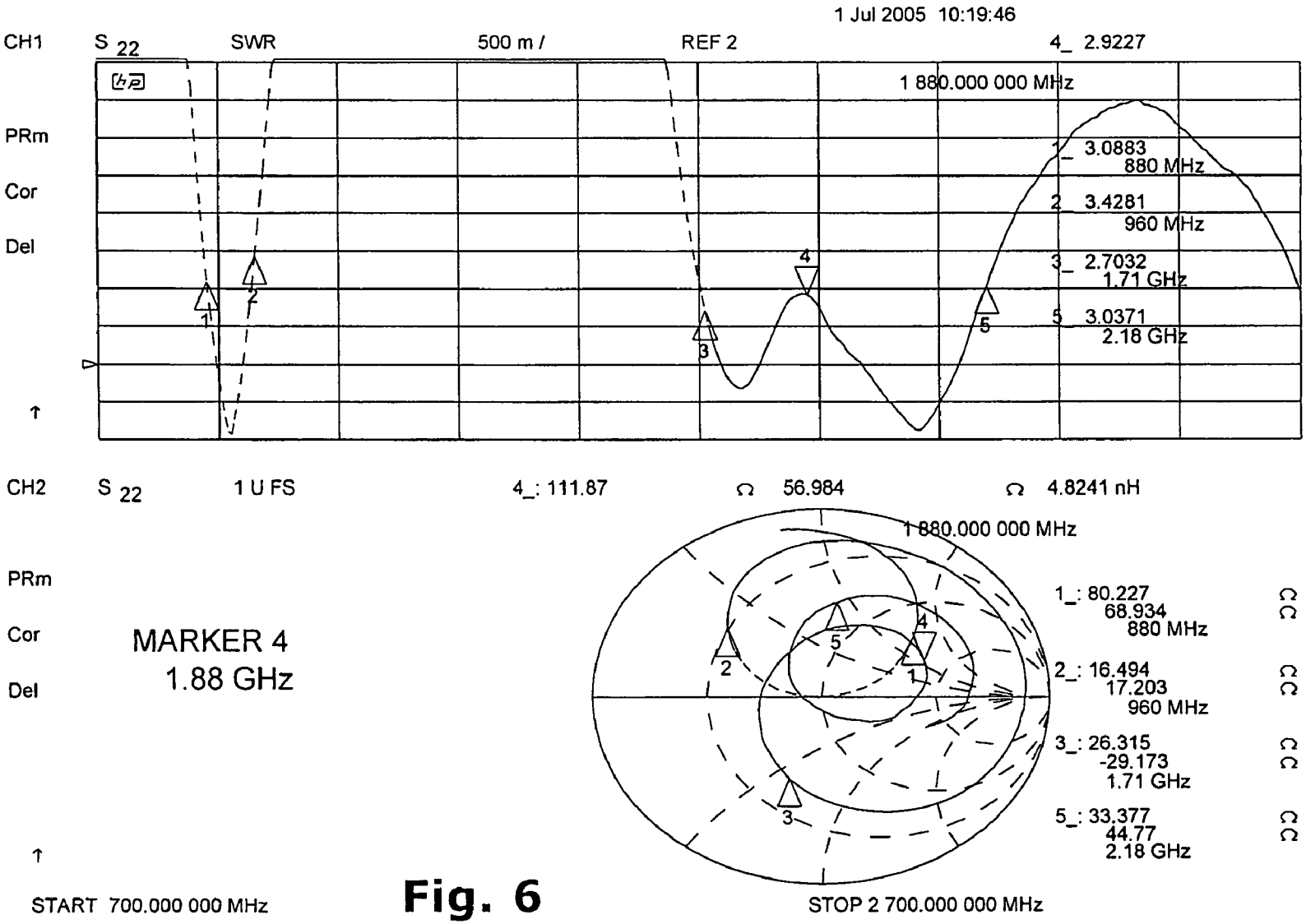
FIG. 6 illustrates the VSWR characteristics for the multi-band radio antenna device of FIG. 5 and a Smith diagram showing the impedance characteristics for the multi-band radio antenna device of FIG. 5.

Exemplary, non-limiting dimensions of a specific embodiment of this antenna device 5 are approximately 40×14×(8) mm. With these smaller dimensions, the VSWR illustrated in FIG. 6 is achieved. While high-band performance is very similar to the exemplary embodiment shown in FIGS. 3 and 4, low-band performance is slightly narrowed with the design of antenna element 5. Band-edge VSWR in the 900 MHz band is approximately 3.2:1.

In comparison to the previous antenna concept shown in FIGS. 1 and 2, the VSWR is significantly improved in the high-band. Note that marker 4 in this case (FIG. 6) has been moved to 2035 MHz to show the last frequency where this concept achieves 3:1 VSWR. The VSWR with this previous concept (FIG. 2) at 2180 MHz is about 7.7:1, and the 3:1 VSWR bandwidth of the previous concept at high-band is about 330 MHz. With the new proposed concept of the embodiment according to FIGS. 5 and 6, the 3:1 VSWR bandwidth is 470 MHz, or an improvement of about 37%

The antenna element of embodiments of the invention achieves about a 35-40% improvement in bandwidth over the first concept shown in the high-band. Furthermore, with slightly reduced performance at low-band and similar performance at high-band a reduction of about 25% in volume is achieved (height dimension of a specific embodiment goes from ~20 to ~15(14) mm).

The antenna devices of embodiments of the invention are in operation, when assembled in a radio communication terminal, connected to RF-circuitry (not shown) via a single feeding point 38, 58 feeding both the first, second and third branch of the device, respectively. In order to achieve best impedance matching the ground connection 39, 59 may comprise matching elements, such as series capacitances or inductance in order to improve performance and impedance matching.

The conductive antenna traces may be attached to a flat support element, such as in the form of a dielectric film, e.g. made of polyimide or polyester. For instance a dielectric film having a thickness of 0.1 mm and being commercially available from 3M Corporation, or a similar dielectric film may be used. The trace of conductive material and the dielectric film together form a flex film, which advantageously has an adhesive film attached to its underside for easy assembly to a radio communication terminal. Alternatively, multi-band radio antenna device according to certain embodiments may be made by directly photo-etching the continuous trace of the antenna device onto a suitable substrate, e.g. a constructive element of a radio communication terminal, such as its housing or a carrier inside such a housing. A further manufacturing alternative is to use a photo-deposition technique for manufacturing the continuous traces of the antenna branches. These techniques, as well as the flexible film, allow to provide the inventive antenna device on curved surfaces. Precision stamping and insert molding techniques may also be used for manufacturing the type of antenna device described herein.

Voltage Standing Wave Ratio (VSWR) relates to the impedance match of an antenna feed point with a feed line or transmission line of a radio communications device. To radiate radio frequency (RF) energy with minimum loss, or to pass along received RF energy to a RF receiver of a radio communication terminal with minimum loss, the impedance of an antenna should be matched to the impedance of a transmission line or the impedance of the feed point.

The Voltage Standing Wave Ratio (VSWR) of the antenna devices is shown in FIGS. 2, 4 and 6. Note that the scale on all VSWR charts shown is 0.5 per division, rather than the 1 per division which is commonly used, in order to show additional resolution. FIGS. 2, 4 and 6 also show a Smith diagram in the lower part of the Figures, respectively. The Smith diagram shows the impedance characteristics for the multi-band radio antenna devices 1, 3 or 5, respectively. Smith diagrams, such as shown in F FIGS. 2, 4 and 6, are a familiar tool within the art and are thoroughly described in the literature, for instance in chapters 2.2 and 2.3 of "Microwave Transistor Amplifiers, Analysis and Design", by Guillermo Gonzales, Ph.D., Prentice-Hall, Inc., Englewood Cliffs, N.J. 07632, USA, ISBN 0-13-581646-7. Reference is also made to "Antenna Theory Analysis and Design", Balanis Constantine, John Wiley & Sons Inc., ISBN 0471606391, pages 43-46, 57-59. Both of these books are fully incorporated in herein by reference. Therefore, the nature of Smith diagrams are not penetrated in any detail herein. However, briefly speaking, the Smith diagrams in this specification illustrate the input impedance of the antenna: $Z=R+jX$, where R represents the resistance and X represents the reactance. If the reactance $X>0$, it is referred to as inductance, otherwise capacitance. In the Smith diagram the curved graph represents different frequencies in an increasing sequence. The horizontal axis of the diagram represents pure resistance (no reactance). Of particular importance is the point at 50 Ohms, which normally represents an ideal input impedance. The upper hemisphere of the Smith diagram is referred to as the inductive hemisphere. Correspondingly, the lower hemisphere is referred to as the capacitive hemisphere.

Figure 7:
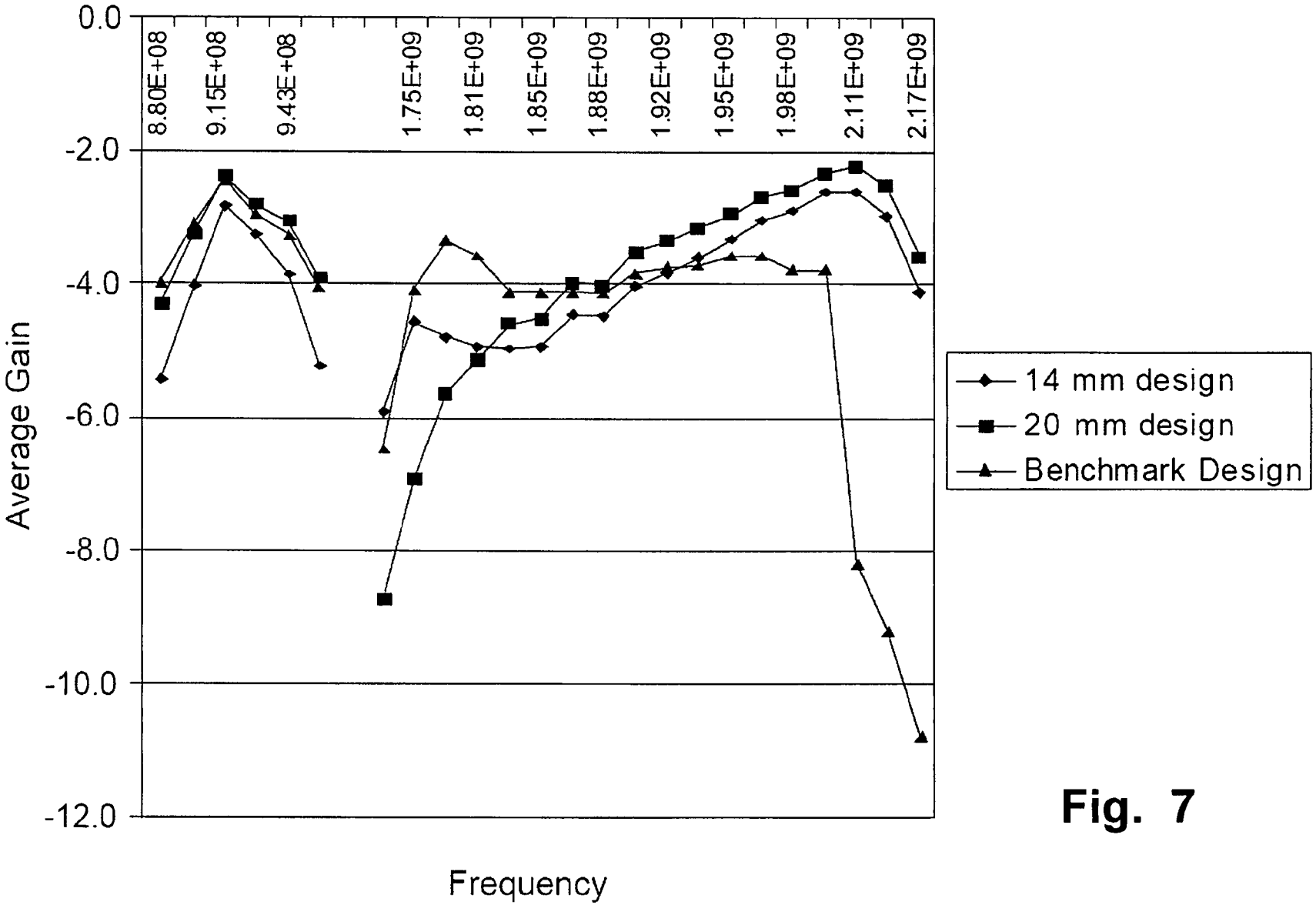
FIG. 7 is a schematic diagram illustrating average gain measurements of different antenna designs.

Comparative gain measurements for implementations of some specific embodiments of the invention based on the above described antenna design (FIG. 3, 5) were performed and measurement results are shown in FIG. 7. The gain measurement curve representing the antenna design denoted "benchmark design" corresponds to the above mentioned example with reference to FIG. 1 (38×23 mm). The gain measurement curve representing the antenna design denoted "20 mm design" corresponds to the above mentioned example with reference to FIG. 3 (38×20 mm), and the gain measurement curve representing the antenna design denoted "14 mm design" corresponds to the above mentioned example with reference to FIG. 5 (40×14 mm). It can be noted that with the same size of an antenna element, there is virtually no degradation in GSM performance and the high-band bandwidth is improved significantly thanks to the improved design of the some embodiments of the invention. Furthermore, with a approximately 25' smaller element substantially similar performance is achieved at high-band and only about 1 dB poorer performance at low-band. This is a substantial miniaturization at comparable performance and hence space efficiency is considerably improved with some embodiments of the invention. Moreover, further tuning may move gain from the UMTS to the DCS band. This may be done through changing the size and spacing of the two high-band branches of the element shown on the right in the Figures, e.g. elements 34, 36 or 54, 56 respectively.

More precisely, the ratio between the widths of elements 34 and 36, and 54, 56 respectively, as well as the gaps between these two branches at the feed and along the length of the element are tuning parameters used to maximize gain of the antenna and to center it on the Smith Chart. In general, it is advantageous to make branches 34, 54 significantly wider than branches 46, 56. The spacing between these two branches (34 and 36, and 54, 56 respectively) is used to rotate the dual impedance on the Smith Chart. Increasing the spacing has the effect of rotating the resonances in a counter clockwise direction. The spacing between 34 and 36, and 54, 56 respectively near the feed points (38, 39 and 58, 59 respectively) is used to move the high-band resonances up and down on the Smith Chart. When the spacing between these two branches near the feeds is decreased, the resonances move down on the Smith Chart (to the capacitive side). When the spacing is increased, the opposite effect is observed. These tuning parameters are well understood to those skilled in the art.

The antenna elements of embodiments of the invention consist of continuous traces of electrically conductive material, preferably copper or another suitable metal with very good conductive properties. An antenna connector serves to connect the antenna to radio circuitry, e.g. provided on a printed circuit board in a mobile telephone 8. The antenna connector may be implemented by any of a plurality of commercially available antenna connectors, such as a leaf-spring connector or a pogo-pin connector.

Moreover, the radio circuitry as such forms no essential part of the present invention and is therefore not described in more detail herein. As will be readily realized by one skilled in the art, the radio circuitry will comprise various known HF (high frequency) and baseband components suitable for receiving a radio frequency (HF) signal, filtering the received signal, demodulating the received signal into a baseband signal, filtering the baseband signal further, converting the baseband signal to digital form, applying digital signal processing to the digitalized baseband signal (including channel and speech decoding), etc. Conversely, the HF and baseband components of the radio circuitry will be capable of applying speech and channel encoding to a signal to be transmitted, modulating it onto a carrier wave signal, supplying the resulting HF signal to the antenna device, etc.

Figure 8:
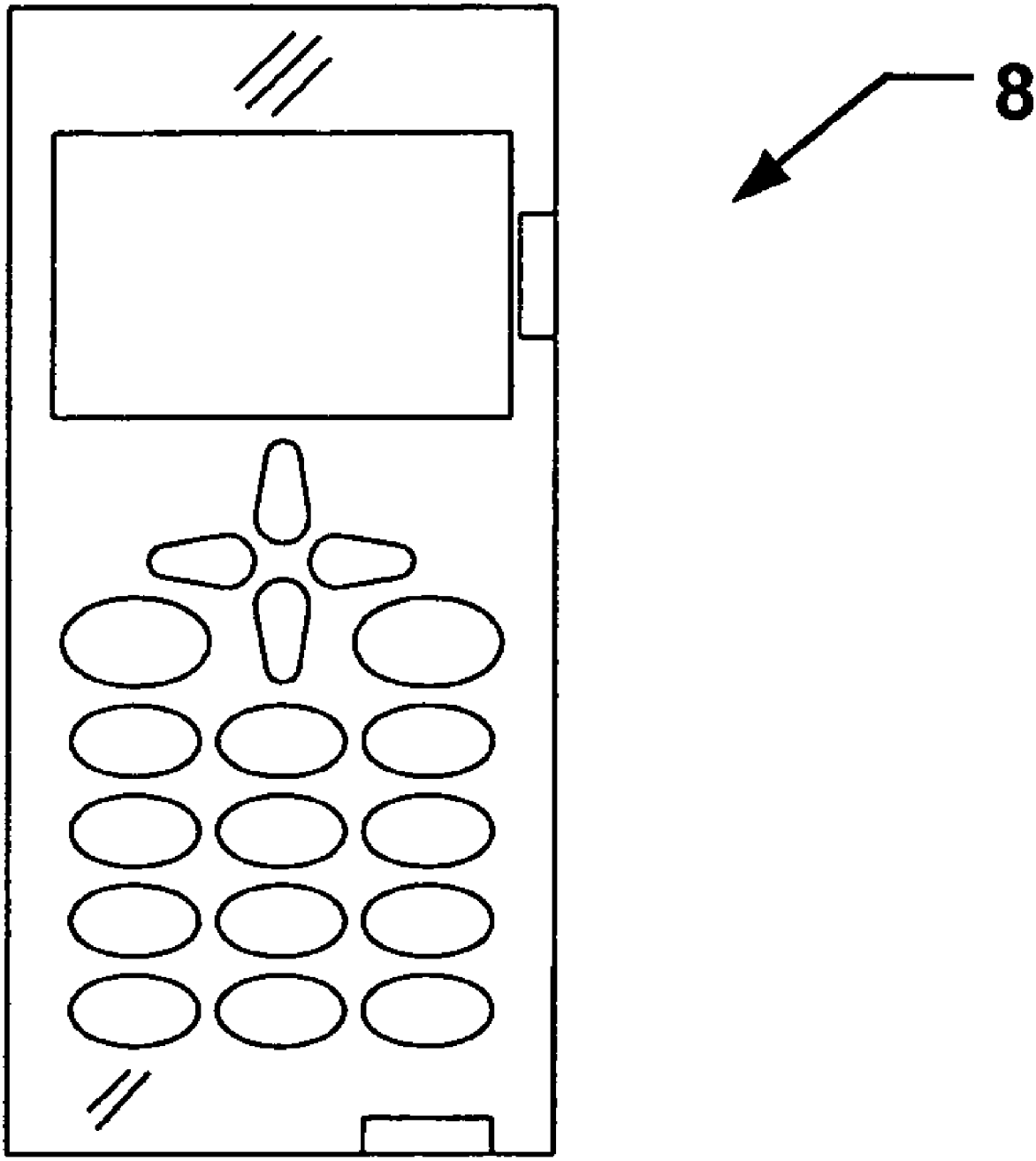
FIG. 8 is a schematic illustration of a radio communication terminal devised for multi-band radio communication.

FIG. 8 illustrates a radio communication terminal 8 in the embodiment of a cellular mobile phone devised for multi-band radio communication. The terminal 8 comprises a chassis or housing, carrying a user audio input in the form of a microphone and a user audio output in the form of a loudspeaker or a connector to an ear piece (not shown). A set of keys, buttons or the like constitutes a data input interface is usable e.g. for dialing, according to the established art. A data output interface comprising a display is further included, devised to display communication information, address list etc in a manner well known to the skilled person. The radio communication terminal 8 includes radio transmission and reception electronics (not shown), and is devised with a built-in antenna device inside the housing.

In some cases it might be advantageous to have one of the shown antenna designs or a variation thereof, depending on various requirements, such as antenna performance versus implementing cost or design flexibility.

A fastening element may be conveniently integrated with the antenna device for mechanically fixing the antenna device to a radio communication device.

In addition to the above, the antenna device of embodiments of the present invention may also be combined with a matching circuit (not shown). This circuit may improve the matching of the antenna device, which in turn improves gain, etc. Any matching configuration may be used, as is well known to those skilled in the art.

In summary, embodiments of the present invention can provide an alternative antenna structure to known structures that is suitable for built-in antennas, at the same time it can have a wide bandwidth of a high-frequency band, which can allow the antenna to be operated at a plurality of frequency bands.

The multi-band radio antenna is a compact antenna device, which may be disposed inside the casing of a mobile communication terminal in order to make the terminal compact and having a low weight.

Embodiments of the invention may enable manufacturers of mobile radio communication terminals to have a built-in antenna device, which may be manufactured in large series at low costs.

The foregoing has described the principles, preferred embodiments and modes of operation of embodiments of the present invention. However, the invention should not be construed as being limited to the particular embodiments discussed above. For example, while the antenna of the present invention has been discussed primarily as being a radiator, one skilled in the art will appreciate that the antenna of the present invention would also be used as a sensor for receiving information at specific frequencies. Similarly, the dimensions of the various elements may vary based on the specific application, for instance other embodiments than those described may have a variant of the illustrated meandering portion having a different pitch. Thus, the above-described embodiments should be regarded as illustrative rather than restrictive, and it should be appreciated that variations may be made in those embodiments by workers skilled in the art without departing from the scope of the present invention as defined by the following claims.

Furthermore, it should be emphasized that the term comprising or comprises, when used in this description and in the appended claims to indicate included features, elements or steps, is in no way to be interpreted as excluding the presence of other features elements or steps than those expressly stated. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality.

What is claimed is:

1. A multi-band radio antenna device for a radio communication terminal, comprising:

an integral feed and ground structure electrically connected to a first radiating antenna element and a second radiating antenna element, said first radiating antenna element comprising a first continuous trace of conductive material, the first continuous trace having a first branch tuned to radiate at first frequencies in a first frequency band, and a second branch, which is tuned to radiate in a second frequency band at second frequencies approximately equal to or less than two times the first frequencies; and said second radiating antenna element comprising a second continuous trace of conductive material, the second continuous trace having a third branch, which is tuned to resonate in a third frequency band at third frequencies that are higher than the second frequencies, and is capacitively coupled to the feed and ground structure and arranged substantially adjacent to the second branch;

wherein the first branch comprises a first section, composing approximately ⅓ to ⅔ of the total length of the first branch, wherein the first section is essentially straight and connected to said feed and ground structure at a first end thereof, and a second section in direct connection to a second end of said first section that is tightly meandered.

2. The multi-band radio antenna device according to claim 1, wherein said second section of said first branch terminates said first branch.

3. The multi-band radio antenna device according to claim 1, wherein said integral feed and ground structure comprises a first ground contact and a feed contact connected to said first branch and said second branch, and a second ground contact connected to said third branch.

4. The multi-band radio antenna device according to claim 1, wherein conductive antenna traces are attached to a support element.

5. The multi-band radio antenna device according to claim 4, wherein the support element comprises a flat support element in the form of a dielectric film.

6. The multi-band radio antenna device according to claim 1, wherein said second branch and said third branch are substantially straight and arranged substantially parallel to each other.

7. The multi-band radio antenna device according to claim 1, wherein said tightly meandered second section is configured to decrease a resonance frequency of high-band currents on the first branch without negatively impacting low-band gain or bandwidth significantly.

8. The multi-band radio antenna device according to claim 1, wherein said tightly meandered second section comprises two meandered sub-sections arranged substantially perpendicular to each other.

9. The multi-band radio antenna device according to claim 1, wherein said first section composes approximately ½ of the total length of the first branch.

10. A radio communication terminal for multi-band radio communication, comprising:

an integral feed and ground structure electrically connected to a first radiating antenna element and a second radiating antenna element, said first radiating antenna element comprising a first continuous trace of conductive material, the first continuous trace having a first branch tuned to radiate at first frequencies in a first frequency band, and a second branch, which is tuned to radiate in a second frequency band at second frequencies approximately equal to or less than two times the first frequencies; and said second radiating antenna element comprising a second continuous trace of conductive material, the second continuous trace having a third branch, which is tuned to resonate in a third frequency band at third frequencies that are higher than the second frequencies, and is capacitively coupled to the feed and ground structure and arranged substantially adjacent to the second branch;

wherein the first branch comprises a first section, composing approximately ⅓ to ⅔ of the total length of the first branch, wherein the first section is essentially straight and connected to said feed and ground structure at a first end thereof, and a second section in direct connection to a second end of said first section that is tightly meandered.

11. The radio communication terminal according to claim 10, wherein the radio communication terminal comprises a mobile telephone.

12. The radio communication terminal according to claim 10, wherein said second section of said first branch terminates said first branch.

13. The radio communication terminal according to claim 10, wherein said integral feed and ground structure comprises a first ground contact and a feed contact connected to said first branch and said second branch, and a second ground contact connected to said third branch.

14. The radio communication terminal according to claim 10, wherein conductive antenna traces are attached to a support element.

15. The radio communication terminal according to claim 14, wherein the support element comprises a flat support element in the form of a dielectric film.

16. The radio communication terminal according to claim 10, wherein said second branch and said third branch are substantially straight and arranged substantially parallel to each other.

17. The radio communication terminal according to claim 10, wherein said tightly meandered second section is configured to decrease a resonance frequency of high-band currents on the first branch without negatively impacting low-band gain or bandwidth significantly.

18. The radio communication terminal according to claim 10, wherein said tightly meandered second section comprises two meandered sub-sections arranged substantially perpendicular to each other.

19. The radio communication terminal according to claim 10, wherein said first section composes approximately ½ of the total length of the first branch.

* * * * *